US006849812B2

(12) United States Patent
Abe et al.

(10) Patent No.: US 6,849,812 B2
(45) Date of Patent: Feb. 1, 2005

(54) INPUT DEVICE

(75) Inventors: Lutz Abe, Erbach (DE); Ulrich Buschmann, Elchingen (DE); Jan Kettula, Espoo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/479,265

(22) PCT Filed: May 22, 2002

(86) PCT No.: PCT/IB02/01799

§ 371 (c)(1),
(2), (4) Date: Jun. 8, 2004

(87) PCT Pub. No.: WO02/099553

PCT Pub. Date: Dec. 12, 2002

(65) Prior Publication Data

US 2004/0217938 A1 Nov. 4, 2004

(30) Foreign Application Priority Data

Jun. 1, 2001 (EP) ..... 01113395

(51) Int. Cl.[7] ..... H01H 9/26
(52) U.S. Cl. ..... 200/5 A; 200/344
(58) Field of Search ..... 200/5 A, 341, 200/344, 314, 512–517, 18, 310, 317; 400/472–496; 341/20, 22

(56) References Cited

U.S. PATENT DOCUMENTS 4,349,708 A 9/1982 Asher
4,489,304 A 12/1984 Hayes
5,194,703 A * 3/1993 Deeg ..... 200/5 A
5,250,771 A * 10/1993 Brusasco et al. ..... 200/553
5,268,542 A * 12/1993 Voll ..... 200/5 A
5,670,759 A * 9/1997 Hsu ..... 200/5 A
6,239,391 B1 * 5/2001 Nishijima et al. ..... 200/5 A
6,590,508 B1 * 7/2003 Howell et al. ..... 341/22
6,677,545 B2 * 1/2004 Kenmochi ..... 200/314

FOREIGN PATENT DOCUMENTS

JP 2004093568 A * 3/2004 ..... G04B/25/04
WO 9007786 7/1990

* cited by examiner

*Primary Examiner*—Elvin Enad
*Assistant Examiner*—Lisa Klaus

(57) ABSTRACT

An input device for inputting at least two control commands into an electronic system, having a housing (10) accommodating a combined switching and encoding circuit device (13) with a switching control means (15) and an encoding control means (16); and first and second manually accessible operating elements (19, 20) for operating the switching control means (15) and the encoding control means (16), respectively. To provide another input device that allows eyes-free operation of multiple functions and has an improved robustness, a separation means (22) is arranged between the first and the second operating element (19, 20) so as to clearly separate the operations of the elements from each other.

13 Claims, 2 Drawing Sheets

INPUT DEVICE

CROSS-REFERENCE TO RELATED APPLICATIONS

This application is the U.S. national stage of International Application Number PCT/IB02/01799 filed May 22, 2002 and claiming priority from European Application Number 01113395.6 filed Jun. 1, 2001.

BACKGROUND OF THE INVENTION

1. Technical Field

The present invention relates to an input device for inputting at least two control commands into an electronic system, like a radio and/or stereo system, a navigation system or a computer.

2. Discussion of Related Art

Input devices, such as push buttons require a re-adjustment of the finger whenever another button has to be pressed, i.e. most users of push buttons look to the device before they push the button in order to check the right position of the finger and after the push in order to check if the operation was successful. Therefore, there is a problem in case that the user has to perform parallel tasks, e.g. inputting several commands by an input device to navigate through a menu for selecting desired operations of a device while watching a monitor that displays the available menu or operation, this results in distracting the attention from the monitor to the input device, i.e. to the push buttons.

Touch pads or track points do not deliver tactile feedback on operation, i.e. the user has to check a monitor or another display once per touch to confirm that the operation was successful. Thus, such input devices suffer from the same problems as described above in connection with push buttons.

Joysticks, which can be used to input different commands by moving it into different directions are usually operated by holding the hand on the top thereof. Usually eight or nine different commands can be input by moving it in different directions and eventually by pushing it down or by pushing an additional button provided thereon.

However, problems occur when a joystick is used in a mobile environment, e.g. in a car environment. In such an enviroment external accelerations act on the joystick that has to be regarded as a lever and applies a torque to the joystick. As neither the weight of the hand, nor the length of the stick, nor the accelerations are neglectible an unwanted torque caused by external accelerations must be explicitly compensated to avoid accidental operations. Thus, the handling of available joysticks is stiff and uncomfortable.

Further, joysticks as well as track points must withstand accidental hits. E.g. in a car environment forces up to 25 kg can be act on such devices and require a robust design thereof. The result is a less sensitive handling.

Therefore, navigation systems and other electronic systems in particular for use in a car or vehicle environment uses either only push buttons or turn-push buttons which suffer from the problems mentioned above.

DISCLOSURE OF INVENTION

In view of the above discussion, the object of the present invention is to provide another input device that allows eyes-free operation of multiple functions and has an improved robustness.

According to the present invention an input device for inputting at least two control commands into an electronic system, that has a housing accommodating a combined switching an encoding circuit device with a switching control means and an encoding control means and first and second manually accessible operating elements for operating the switching control means, respectively, is provided with a separation means that is arranged between the first and the second operating element so as to clearly separate the operations of the elements from each other.

According to the present invention two different kinds of control commands, one of which can be input by switching and the other by encoding, can be input by specific operating elements which are separated by corresponding separation means. Therefore, switching, which can be performed e.g. by shifting or pushing a button is separated from encoding operation that can be performed e.g. by rotating a rotary element. In particular, the operating elements are provided in two separate levels which are defined by the separation means. Therefore, the inventive input device can be used without confusing or mixing the operations as it can happen in prior art devices such as turn-pushbuttons or joysticks.

According to an advantageous refinement of the present invention the separation means is formed as a plate having a through hole and being in parallel with a rotary control knob of the encoding control means facing an inner surface of the plate and the first operating element of the switching control means is formed by an operating lever which extends through the through hole so that the plate surrounds the operating lever like a ring. In this way it is possible to restrict the radial or lateral deviation of the operating lever from its normal position to an amount that is slightly greater than the deviation during normal switching operation. Therefore, it is possible to prevent the inventive input device from being damaged by excessive deviations caused by improper use or overload.

To protect the operating lever and the combined switching and encoding circuit device from being destroyed by large external forces acting in the longitudinal direction of the lever it is provided that a circular operating plate is provided at the outer free end of the operating lever so as to form an operating button; and a ring-shaped projection surrounding the through hole is provided on the outer surface of the plate and facing the circular operating plate, the ring-shaped projection forms a stop for the operating button in case that an overload is acting thereon, wherein the plate is supported on a base plate of the housing by two pillars so as to form a bridge-shaped cover of the housing, In this way it is possible to restrict the way along which the operating lever can be moved in its longitudinal direction to such an amount that the destruction of the lever and/or the combined switching and encoding circuit device can be excluded.

An improved robustness can be obtained when the individual elements of the bridge-shaped cover are integrally formed preferably by injection molding.

To improve the protection of the combined switching and encoding circuit device and its operating lever it is provided that the combined switching and encoding circuit device is resiliently supported on the base plate of the housing, wherein the combined switching and encoding circuit device is located on a mounting plate which is resiliently supported on the base plate of the housing by means of a resilient rest formed by at least one spring.

In this way, it is possible to allow the circuit device to move along with the operating lever when it is pushed down by an overload whereas the resilient force that urges the mounting plate back into its normal operating position is lower than a force able to break off the lever from the circuit device but greater than the force necessary to operate the lever for performing switching. Therefore, the force with which the lever is pushed against the circuit device can be restricted to an upper level that is defined by the spring elements.

To further improve the handling of the inventive input device, the housing comprises at least one, preferably two operating windows which are symmetrically arranged and through which the rotary control knob is accessible. In this case it is of advantage when each of the operating windows provides first and second operating stops at its circumferential ends.

BRIEF DESCRIPTION OF THE DRAWINGS

An exemplary embodiment of the present invention is described in detail below with reference to the accompanying drawings. In the drawings.

BEST MODE FOR CARRYING OUT THE INVENTION

Identical parts and elements are consequently provided with the same reference symbols throughout the drawings.

Figure 1:
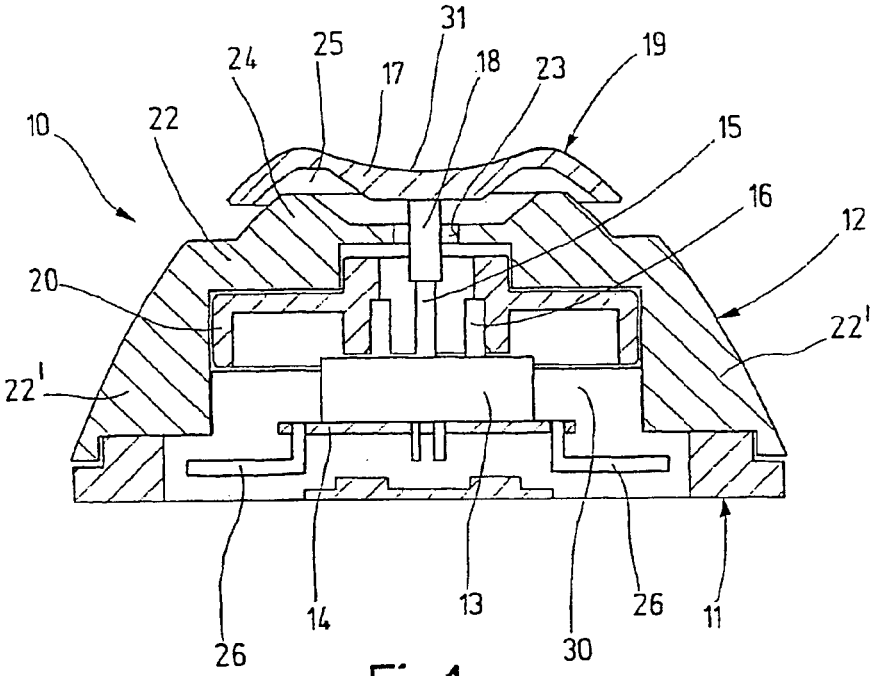
FIG. 1 shows a simplified schematic cross sectional view of an input device according to the present invention.

Referring to FIG. 1, an input device according to the present invention comprises a housing 10 with a base plate 11 for mounting the input device onto a respective mounting surface (not shown) and a bridge-shaped cover 12. A combined switching and encoding circuit device 13 is accommodated within the housing 10, and in particular located on a mounting plate 14 that is resiliently supported on the base plate 11 as described hereinafter in more detail.

The switching and encoding circuit 13 comprises a switching control means 15 and encoding control means 16. The switching control means is formed by an operating lever 15 that carries an operating plate 17 connected thereto by means of an extension sleeve 18 or any other suitable extension means for extending the length of the operating lever 15 so as to form an operating button 19. The button 19 can be shifted in different radial directions so as to pivot the operating lever 15 for performing switching operations provided by the combined switching and encoding circuit 13. In addition, the button 19 can be pushed down in the longitudinal direction of the operating lever 15 so as to perform another switching operation. Thus, the button 19 forms a push-shift button for generating a first kind of several control commands to be input into an electronic system.

The encoding control means 16 are coupled to a rotary knob 20 that is accommodated in the bridge-shaped cover 12.

Figure 2:
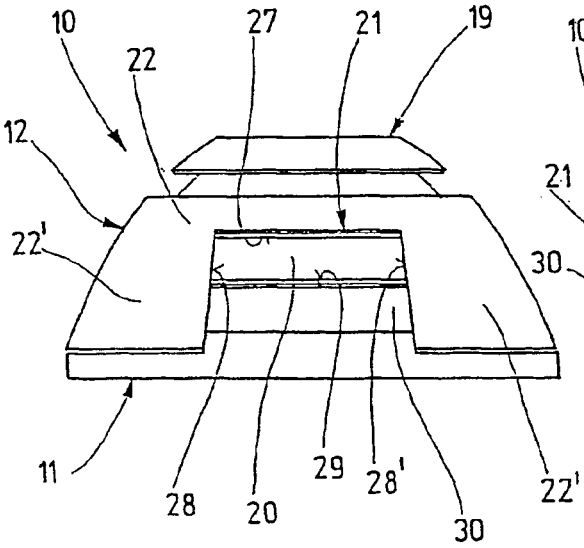
FIG. 2 shows a front view of the input device according to FIG. 1.
Figure 3:
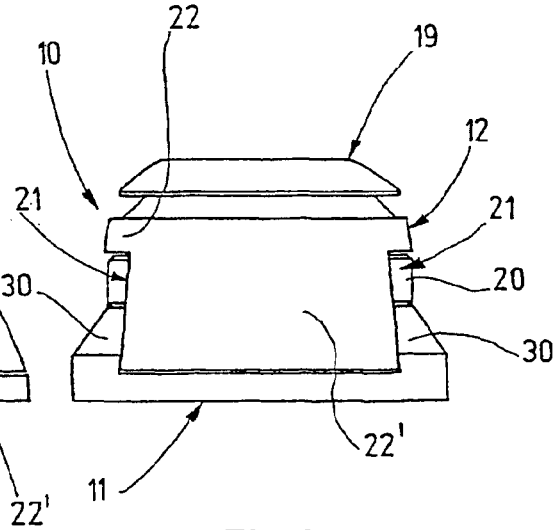
FIG. 3 shows a sight view of the input device according to FIG. 1 or 2.

To provide manual access to the rotary knob 20 at least one, preferably two operating windows 21 are provided on both sides of the housing 10 (cf. FIGS. 2 and 3). The operating windows 21 are symmetrically arranged with regard to a center plane of the housing 10 to improve handling of the input device. Further it is possible to locate the operating windows 21 diametrically to the rotary axis of the knob 20.

To protect the combined switching and encoding circuit 13, in particular the switching elements operated by the operating lever 15 against destruction due to overload acting on the operating lever 15, the bridge-shaped cover 12 comprises a plate 22 that is supported on the base plate 11 by means of two pillars 22'. This plate 22 includes a through hole 23 through which the operating lever and/or the sleeve 18 extends so that the operating plate 17 of the button 19 is located on the outside of the housing 10. On the outer side of the plate 22 a ring shaped projection 24 is provided that forms a stop for the button 19 when it is moved in the longitudinal direction of the operating lever 15 due to overload. The cross sectional shape of the ring shaped projection 24 is similar to that of the cross sectional shape of an angular groove 25 provided in the lower side of the operating plate 17 of the button 19 so that the operating plate 17 and in consequence the lever 15 are centered when an overload is acting on the button 19.

Figure 7:
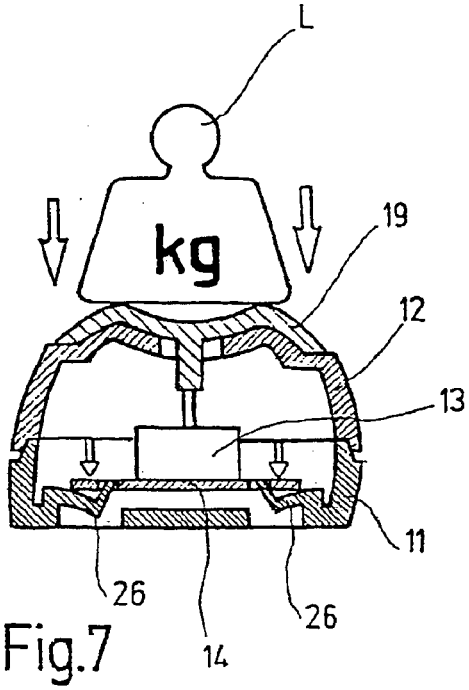
FIG. 7 shows a cross sectional view similar to that according to FIG. 6 for explaining the protecting operation during overload.

So as to limit the force acting on the operating lever 15 even in the case of an overload L (cf. FIG. 7) the mounting plate 14 supporting the combined switching and encoding circuit 13 is resiliently supported by spring elements 26 each being connected with the base plate 11 at one end and supporting the mounting plate 14 at its other end. Thus the spring elements 26 form a resilient rest for the mounting plate 14. The spring force provided by the spring elements 26 is greater than the operating force needed for performing switching operations by means of the shift-push button 19, but is less than a breaking force that would destroy the connection between the operating lever 15 and the combined switching and encoding circuit 13.

The operating windows 21 through which the rotary knob 20 is manually accessible are defined by the lower (or inner) surface 27 of the plate 22, first and second shoulders 28, 28' formed by respective surfaces of the pillars 22' facing each other at the circumferential ends of the access window, and by an upper (or inner) surface 29 formed on a projecting part 30 of the base plate 11. The projecting part 30 has a substantially conical outer surfaces adjacent to the operating windows 21. These surfaces form rests for the operator's thumb and finger in particular during operating the rotary knob 20. Thus, the handling of the device can be further improved.

Figure 4:
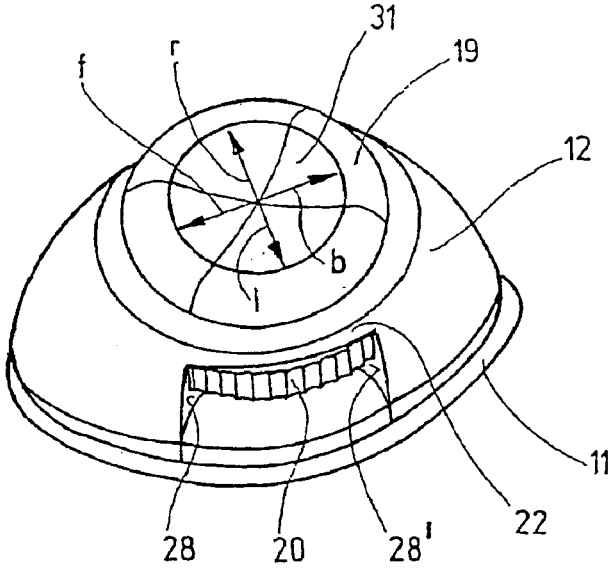
FIG. 4 shows a perspective view of an input device according to the present invention similar to that shown in FIGS. 1 to 3.
Figure 5:
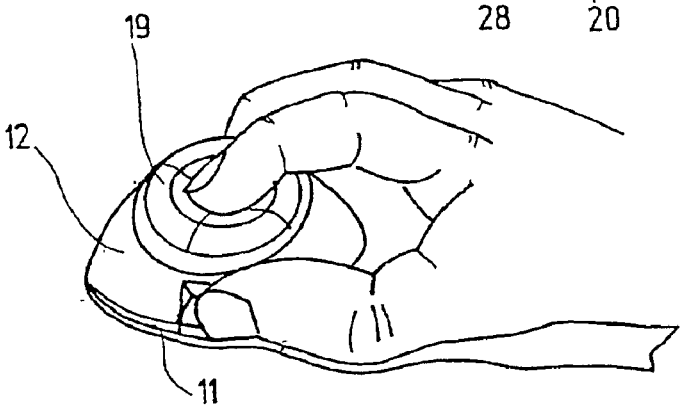
FIG. 5 shows a perspective view of the input device according to FIG. 4 in the state of being manually operated.

As can be seen best in FIGS. 4 and 5 the input device according to the present invention may have an elliptical shape the great or longitudinal axis of which defines a forward-backward-direction whereas the small or transversal axis defines a left-right direction as indicated by the arrows f, b and 1, r, respectively.

According to the explained embodiment of the invention the input device offers seven possibilities of operating the combined switching and encoding circuit. At first, the button 19 can be shifted forward and backward, left and right. Then, the button 19 can be pushed down. Thus, the button 19 provides five of seven operating directions. The rotary knob 20 coupled with the encoding control means 16 can be rotated left and right thus, providing the other two of seven operating directions.

Further, if needed, four additional shift directions may be added, i.e. the directions forward-left, forward-right, backward-left, and backward-right.

As can be best seen in FIG. 5 the fingers of an operator's hand can rest on the input device in such a way that the index finger will operate the pushshift button 19 whereas the thumb and/or another finger rotates the rotary knob 20. During rotating the rotary knob 20 the shoulders 28, 28' serve as operating stops which improve the handling of the inventive input device. While keeping the permanent grip of the input device the operation of the rotary knob 20 is clearly separated from the other operations of the push-shift button 19 by means of the plate 22 of the bridge-shaped cover 12 that is located between the rotary knob 20 and the button 19. Therefore, a confusion or unintended mixing of both kinds of operations can be safely prevented.

Due to its specific shape with the access windows for the rotary knob 20 at the side portions of the device it is suitable to support eyes-free operation.

In addition, due to the rather short length of the operating lever 15 (including the length of the extension element, i.e. the sleeve 18) the effect of an external torque is minimized, if the inventive input device may be used in a car environment. To improve the operability of the button 19 the upper or outer surface thereof is provided with a shallow bowl-shaped recess 31.

Figure 6:
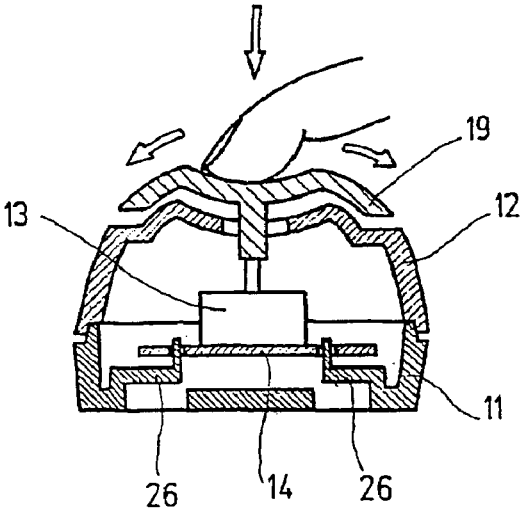
FIG. 6 shows a further simplified schematic cross sectional view of an input device according to the present invention for explaining the operating of a push-shift button.

As indicated in FIG. 6 the spring elements 26 supporting the mounting plate 14 for the combined switching and encoding circuit 13 provides a supporting force that is greater than the operating force for shifting and pushing the button 19. However, as can be seen from FIG. 7, in case that an overload L, in particular an overload up to 25 kg is acting on the button 19. The button 19 is pressed down but stopped by the annular projection 24 of the bridge-shaped cover 12 whereas the spring elements 26 are resiliently bent down so that destruction of the combined switching and encoding circuit 13 can be prevented, since the supporting force of the spring elements 26 is smaller than the force necessary for destroying the connection between the operating lever 15 and the combined switching and encoding circuit 13.

What is claimed is:

1. Input device for inputting at least two control commands into an electronic system, having a housing (10) accommodating a combined switching and encoding circuit device (13) with a switching control means (15) and an encoding control means (16); and first and second manually accessible operating elements (19, 20) for operating said switching control means (15) and said encoding control means (16), respectively;

characterized in that a separation means (22) defining two separate levels is formed with a through hole (23) and being in parallel with a rotary control knob (20) of said encoding control means (16) arranged in a first one of said two levels and facing an inner surface (27) of said separation means (22), and said first operating element (19) for said switching control means is formed by an operating lever (15, 18) which extends through said through hole (13) so that said separation means (22) surrounds said operating lever (15, 18) like a ring and so that a manually accessible portion (17) of said operating element (19) is arranged in a second one of said two levels so as to clearly separate the operations of the elements from each other.

2. Input device as claimed in claim 1, characterized in that said separation means is formed as a plate (22).

3. Input device as claimed in claim 2, characterized in that a circular operating plate (17) is provided at an outer free end of said operating lever (15, 18) so as to form an operating button (19); and a ring-shaped projection (24) surrounding said through hole (23) is provided on an outer surface of said plate (22) and facing said circular operating plate (17), said ring-shaped projection (24) forming a stop for said operating button (19) in case that an overload is acting thereon.

4. Input device as claimed in claim 3, characterized in that said plate (22) is supported on a base plate (11) of said housing (10) by two pillars (22') so as to form a bridge-shaped cover (12) of said housing (10).

5. Input device as claimed in claim 4, characterized in that individual elements of said bridge-shaped cover (12) are integrally formed preferably by injection molding.

6. Input device as claimed in claim 2, characterized in that said plate (22) is supported on a base plate (11) of said housing (10) by two pillars (22') so as to form a bridge-shaped cover (12) of said housing (10).

7. Input device as claimed in claim 6, characterized in that individual elements of said bridge-shaped cover (12) are integrally formed preferably by injection molding.

8. Input device as claimed in claim 7, characterized in that said combined switching and encoding circuit device (13) is resiliently supported on said base plate (11) of said housing (10).

9. Input device as claimed in claim 8, characterized in that said combined switching and encoding circuit device is located on a mounting plate which is resiliently supported on said base plate (11) of said housing (10) by means of a resilient rest formed by at least one spring element (26).

10. Input device as claimed in claim 6, characterized in that said combined switching and encoding circuit device (13) is resiliently supported on said base plate (11) of said housing (10).

11. Input device as claimed in claim 10, characterized in that said combined switching and encoding circuit device is located on a mounting plate which is resiliently supported on said base plate (11) of said housing (10) by means of a resilient rest formed by at least one spring element (26).

12. Input device as claimed in claim 2, characterized in that said housing (10) comprises at least one, preferably two operating windows which are symmetrically arranged and through which said rotary control knob (20) is manually accessible.

13. Input device as claimed in claim 12, characterized in that each of said operating windows provides first and second operating stops (28, 28') at circumferential ends thereof.

* * * * *